US007072600B2

(12) United States Patent
Osaki

(10) Patent No.: US 7,072,600 B2
(45) Date of Patent: Jul. 4, 2006

(54) IMAGE FORMING APPARATUS WITH FIXING UNIT FOR FIXING IMAGE

(75) Inventor: Koji Osaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/033,827

(22) Filed: Jan. 13, 2005

(65) Prior Publication Data

US 2005/0152709 A1 Jul. 14, 2005

(30) Foreign Application Priority Data

Jan. 13, 2004 (JP) ..... 2004-005319

(51) Int. Cl.
*G03G 15/20* (2006.01)

(52) U.S. Cl. ..... 399/67; 219/216; 399/69; 399/81

(58) Field of Classification Search ..... 399/67, 399/81, 38, 69, 70, 75, 91, 94, 97; 219/216
See application file for complete search history.

(56) References Cited

U.S. PATENT DOCUMENTS

| | | | | |
|---|---|---|---|---|
| 4,870,447 | A * | 9/1989 | Yoshida et al. | 399/183 |
| 5,049,931 | A * | 9/1991 | Knodt | 399/81 |
| 5,138,379 | A * | 8/1992 | Kanazashi | 399/44 |
| 5,887,220 | A * | 3/1999 | Nagaoka | 399/46 |
| 6,389,241 | B1 * | 5/2002 | Cernusak et al. | 399/44 |
| 6,516,166 | B1 * | 2/2003 | Sakakibara et al. | 399/69 |
| 6,577,826 | B1 * | 6/2003 | Misaizu et al. | 399/45 |
| 6,885,834 | B1 * | 4/2005 | Ito et al. | 399/67 |
| 6,889,018 | B1 * | 5/2005 | Kinouchi et al. | 399/69 |
| 6,898,388 | B1 * | 5/2005 | Uehara et al. | 399/69 |
| 2004/0184830 | A1 * | 9/2004 | Miyamoto et al. | 399/66 |

* cited by examiner

*Primary Examiner*—Hoan Tran
(74) *Attorney, Agent, or Firm*—Takeuchi&Kubotera, LLP

(57) ABSTRACT

An image forming apparatus includes an image forming unit for forming a developer image on a recording medium (22), a fixing unit (21) for fixing the developer image on the recording medium (22), an operation unit (11*b*), and a fixing section regulation unit for regulating the fixing section based on the fixing conditions set by manipulating the operation unit (11*b*). The fixing unit is regulated based on the fixing conditions set by manipulating the operation unit (11*b*) so that the optimal image quality can be obtained for a variety of record medium (22).

19 Claims, 4 Drawing Sheets

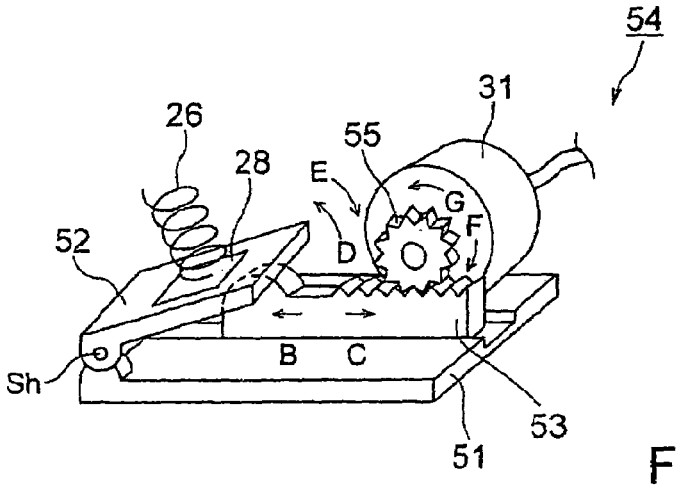
FIG. 2
ENVIRONMENT 26~32 [℃] 、60~80 [%]
ENVIRONMENT 15~26 [℃] 、30~60 [%]
ENVIRONMENT 5~15 [℃] 、10~30 [%]
| THICKNESS | TYPES | TEMP. | PRESSURE |
|---|---|---|---|
| THIN | ORDINARY | 180 [℃] | 6 [Kg] |
| | ROUGH | 190 [℃] | 6 [Kg] |
| ORDINARY | ORDINARY | 200 [℃] | 6 [Kg] |
| | ROUGH | 210 [℃] | 6 [Kg] |
| THICK | ORDINARY | 220 [℃] | 8 [Kg] |
| | ROUGH | 230 [℃] | 8 [Kg] |
FIG. 3
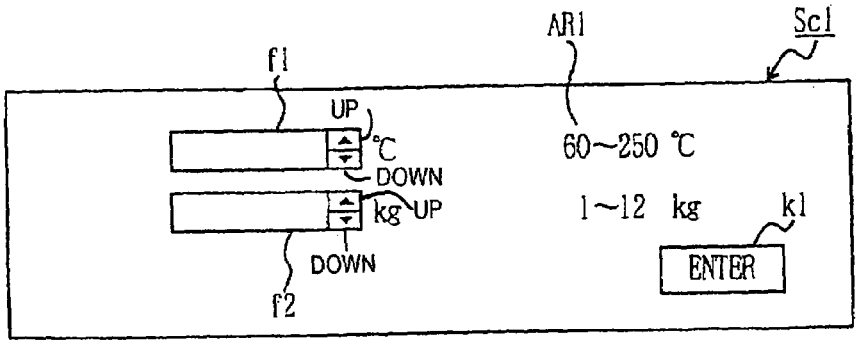
FIG. 4

IMAGE FORMING APPARATUS WITH FIXING UNIT FOR FIXING IMAGE

BACKGROUND OF THE INVENTION

1. Field of the Invention

The present invention relates to image forming apparatus.

2. Description of the Related Art

An image forming apparatus, such as an electrophotographic printer, copier, or facsimile machine, makes an image by forming an electrostatic latent image on a photosensitive drum with a laser, developing the latent image with a toner to provide a toner image, transferring the toner image from the photosensitive drum to a recording medium, and fixing the toner image onto the recording medium.

The main control unit of a printer, for example, reads the recording medium information from the recording unit and looks up the setting tables in the record unit to determine the printing conditions, such as the transfer voltage applied to the transfer roller for transferring the toner image to the recording medium from the photosensitive drum, the fixing voltage for supplying the minimum heat for requiring the fixing of the toner image, and the transportation speed of the recording medium for compensating the transfer voltage and the fixing voltage. See JP 2001-242742.

However, the number of types of recording mediums used in the printer is so large that the image quality of prints made with only the printing conditions recorded in the setting tables is not necessarily good. The optimal printing conditions vary with the type of recording medium so that the types of recording mediums that can provide a certain image quality with similar printing conditions are grouped together to make setting tables for a limited number of types of recording mediums. Consequently, the common printing conditions are used for a plurality of types of recording mediums so that the optimal image quality is not provided for a certain type of recording medium.

SUMMARY OF THE INVENTION

Accordingly, it is an object of the invention to provide an image forming apparatus capable of providing the optimal image quality for a variety of recording mediums.

According to the invention there is provided an image forming apparatus which includes an image forming unit for forming a developer image on a recording medium, a fixing unit for fixing the developer image on the recording medium, an operation unit, and a fixing unit regulation unit for regulating the fixing unit based on the fixing conditions set by manipulating the operation unit.

According to the invention, the fixing unit is regulated based on the fixing conditions set by manipulating the operation unit so that it is possible to provide the optical image quality for a variety of types of recording mediums.

BRIEF DESCRIPTION OF THE DRAWINGS

FIG. 2 is a perspective view of the pressure regulation mechanism of a fixing unit according to the first embodiment;

FIG. 3 is a diagram showing set tables of the standard fixing conditions according to the first embodiment;

FIG. 4 is a diagram showing a fixing condition setting screen according to the first embodiment;

DESCRIPTION OF THE PREFERRED EMBODIMENTS

Figure 1:
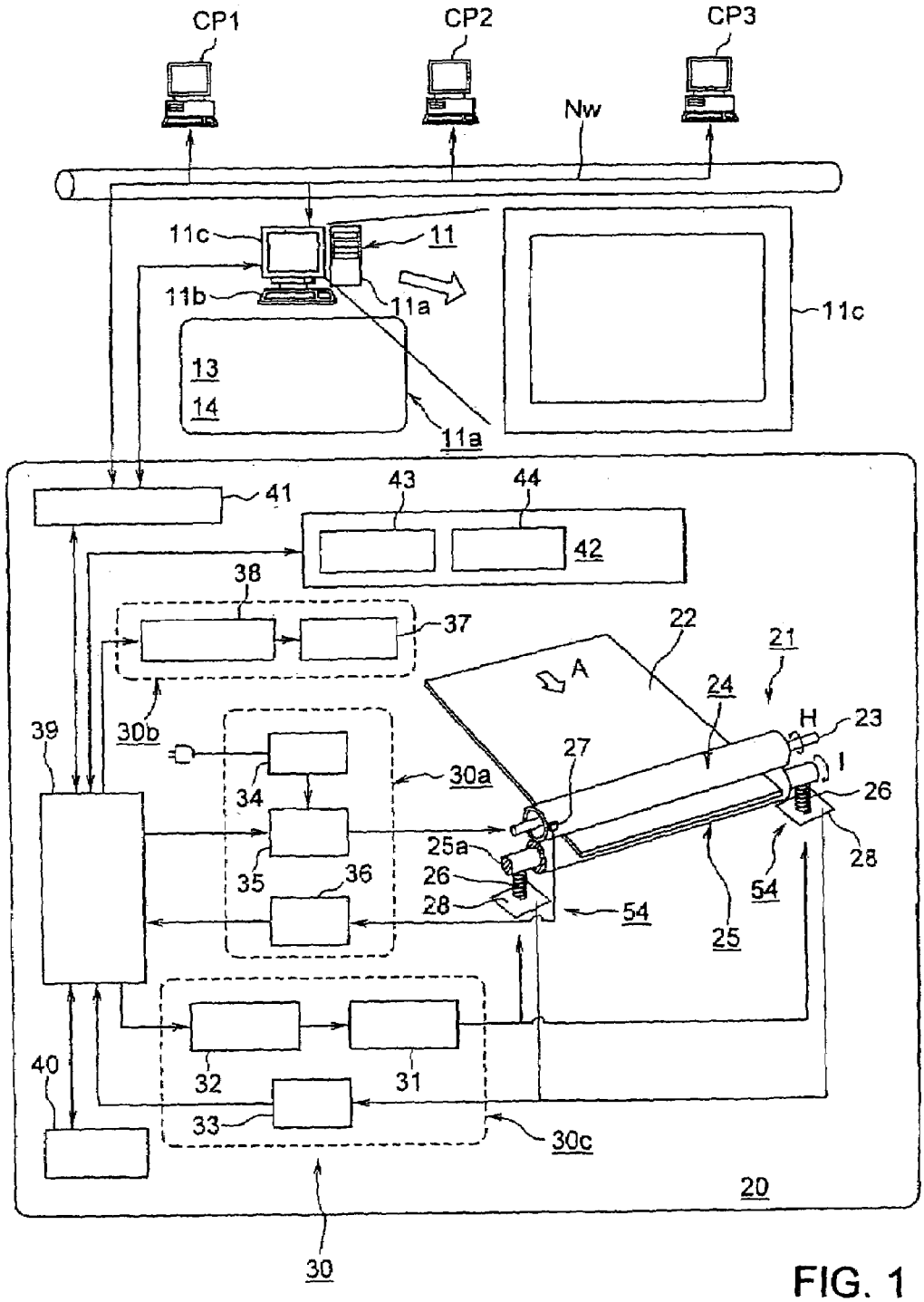
FIG. 1 is a schematic diagram of a printing system according to the first embodiment of the invention.

In FIG. 1, an upper unit or computer 11 is connected to a plurality of other computers CP1, CP2, etc. via a network NW and includes a body section 11*a*, an operation section 11*b*, such as a keyboard, and a display section 11*c* such as a display. The body section 11*a* includes a control section consisting of a CPU, MPU, etc. (not shown), a storage or recording section, such as a RAM and ROM, and a data transmission section for sending to and receiving from a printer 20 a variety of data such as print data and printing conditions. Applications 13 and driver software 14 for sending the data to the printer 20 are installed in the ROM. A predetermined screen is formed on the display section 11*c*. An interface, such as a serial, parallel, or network interface, is used for connection between the computer 11 and the printer 20. The control method of each interface is standardized.

The printer 20 includes a printing mechanism, a control unit 30, a recording unit 40, such as RAM and ROM, a data transmission unit 41 that is an external interface for data transmission from and to the computer 11, and an operation unit 42. The printing mechanism includes an image bearing body or photosensitive drum (not shown), a charging unit or roller (not shown) for uniformly charging the surface of the photosensitive drum, an exposing unit or recording head (not shown) for exposing the surface of the photosensitive drum to form an electrostatic latent image, a developing unit (not shown) for developing the latent image to form a toner image, a transfer unit or roller (not shown) for transferring the toner image to a recording medium 22, such as paper or OHP sheets, and a fixing unit 21 for fixing the transferred toner image onto the recording medium 22. The photosensitive drum, the charging roller, the recording head, the developing unit, and the transfer roller constitute an image forming section.

The control unit 30 includes a main control section 39 for controlling the entire printer 20, a heat controlling section 30*a* for controlling the temperature of the fixing unit 21, a transfer control section 30*b* for controlling transfer of the recording medium 22 in the fixing unit 21, and a pressure control section 30*c* for controlling the pressure of the fixing unit 21. The heat control section 30*a* includes a power source 34 to be connected to electrical outlet, an output switch 35, and an A/D converter 36. The transfer control unit 30*b* includes a driver 37 made up of a motor, etc. and a driver control 38 for controlling the driver 37. The pressure control section 30*c* includes a driver 31 made up of a stepping motor for pressure control, etc., a pressure regulator 32, and an A/D converter 33.

The fixing unit 21 includes the first or heat roller 24 and the second or pressure roller 25 for pressing the recording medium 22 against the heat roller 24 with a predetermined bias. A heat generator 23 for heating the recording medium 22 is provided within the heat roller 24 to fix the toner to the recording medium 22. The heat roller 24 and the pressure roller 25 constitute the fixing unit 21.

A temperature detector or sensor 27 is disposed in contact with or opposed to the heat roller 24 to detect the surface temperature of the heat roller 24. The sensor output or temperature detected by the temperature sensor 27 is subjected to A/D conversion in the A/D converter 36 and sent to the main control section 39. The heat roller 24 is connected to the driver 37 via a driving gear (not shown), and the driver control 38 drives the driver 37 according to instructions from the main control section 39 to rotate the heat roller 24. Consequently, the recording medium 22 is transported at a predetermined speed in the direction of arrow A. A pair of pressure regulation mechanisms 54 are provided below opposite ends of a shaft 25*a* of the pressure roller 25 to regulate the pressure upon the heat roller 24.

In FIG. 2, the pressure regulation mechanism 54 includes a fixed support or base 51, a movable support or base 52 hinged to the fixed base 51 with a shaft Sh for swinging motion in directions of arrows D and E, a pressure detector or sensor 28 provided on the movable base 52, a biasing member or coil spring 26 fixed to the pressure sensor 28 at one end and to the shaft 25*a* at the other end, a laterally movable member or lack 53 provided between the fixed and movable bases 51 and 52 for movement in directions of arrows B and c to swing the movable base 52, and a rotary member or pinion 55 engaged with the lack 53 and being rotatable in directions of arrows F and G. This pinion 55 is attached to an output shaft of the driver 31. The pressure of the coil spring 26 is applied to the pressure roller 25 via the shaft 25*a* and the heat roller 24 via the recording medium 22. The pressure detected by the pressure sensor 28 is subjected to A/D conversion in the A/D converter 33 of the pressure control section 30*c* and sent to the main control section 39.

Setting tables of such standard fixing conditions as shown in FIG. 3 are recorded in the recording unit 40. In the setting table, each standard value of the fixing temperature and pressure has been computed and recorded corresponding to the thickness ("thin", "ordinary", or "thick"), the type ("ordinary paper" or "rough paper"), and the environment (temperature "5–15", "15–26", or "26–32" degrees cent. and humidity "10–30", "30–60", or "60–80" percent). In this embodiment, the surface condition of the recording medium 22 is represented by the type of the recording medium 22. The fixing temperature and pressure can be set to other values than the standard values by manipulating the operation section 11*c* of the computer 11.

In FIG. 4, when the operator manipulates the operation section 11*b* of the computer 11 (FIG. 1) to select the fixing condition setting menu, the display processor of the control section in the computer 11 performs a display process to form on the display section 11*c* such a fixing condition setting screen Sc1 as shown in FIG. 4, which includes a spin box f1 for entering the fixing temperature, a spin box f2 for entering the fixing pressure, and an area AR1 for indicating the lower and upper limits of an input range. Then, the operator manipulates the operation section 11*b* in view of the input range to enter figures of the fixing temperature and pressure for the fixing conditions. The figures in the spin boxes f1 and f2 can be changed to the desired ones by pushing a figure changing button "UP" or "DOWN" provided adjacent to the spin boxes. Thus, the display processor displays the entered fixing conditions on the fixing condition setting screen Sc1.

Then, when the operator depresses the ENTER key k1, the figures entered in the spin boxes f1 and f2 are confirmed, and the fixing conditions are sent to the printer 20 by the driver software 14 together with a predetermined command. When the computer 11 sends the fixing conditions to the printer 20, a fixing condition setting means of the main control section 39 performs a fixing condition setting process to set the fixing conditions and record them in the recording unit 40. Simultaneously, the identification information set in the computer 11 for identification is sent to the printer 20, and the main control section 39 records the identification information in the recording unit 40 together with the fixing conditions. Thus, the fixing conditions are set as the printing conditions for the optimal image forming conditions.

The temperature control of the heat roller 24 is made by the temperature sensor 27 and the heat control 30*a*. When the sensor output of the temperature sensor 27 is converted by the A/D converter 36 and sent to the main control section 39, the first fixing section regulator or heat control (not shown) of the main control section 39 performs the first fixing section regulation process or heat control process to read the A/D converted sensor output and temporarily record in the recording unit 40 as a detected temperature value. The heat control reads the detected temperature value and fixing temperature from the recording unit 40 for comparison and switches by means of the output switch 35 the output of the power source 34 based on the comparison result to control the current supplied to the heat generator 23 such that the temperature of the heat roller 24 becomes equal to the set fixing temperature.

If the detected temperature value is lower than the fixing temperature, the heat control issues a command to the output switch 35 to switch the output so as to supply electric current to the heat generator 23. As the heat generator 23 is supplied with electric current, the heat roller 24 is heated up to raise the surface temperature. When the detected temperature value becomes higher than the fixing temperature, the heat control issues a command to the output switch 35 to stop supply of the current to the heat generator 23.

When the current supply is stopped, the detected temperature value gradually falls. When the detected temperature value becomes lower than the fixing temperature, the heat control issues again a command to the output switch 35 to switch the output so as to supply the heat generator 23 with electric current. Thus, the heat roller 24 is regulated and the temperature is controlled such that the detected temperature value becomes substantially equal to the fixing temperature, keeping the surface temperature of the heat roller 24 substantially constant.

The pressure control of the pressure roller 25 is made by the pressure sensor 28 and the pressure control section 30*c*. When the sensor output of the pressure sensor 28 is converted in the A/D converter 33 and sent to the main control section 39, the second fixing section regulation means or pressure control means of the main control section 39 performs the second fixing section regulation process or pressure control process to read the converted sensor output and temporarily record as the detected pressure value in the recording unit 40. The pressure control means reads the detected pressure value and the fixing pressure from the recording unit 40 to compare the detected pressure value and the fixing pressure. Based on the comparison result, the pressure control 32 operates the driver 31 such that the pressure of the pressure roller 25 becomes equal to the fixing pressure at which the pressure of the heat roller 24 is set.

If the detected pressure value is lower than the fixing pressure, the pressure control means outputs a command to the pressure regulator 32 to drive the driver 31 in the direction of arrow F, which rotates the pinion 55 in the same direction to advance the lack 53 in the direction of arrow B. Consequently, the movable base 52 is rotated in the direction of arrow D and pushed up, which pushing up the coil spring 26, thereby increasing the pressure with which the pressure roller 25 is pressed against the heat roller 24. When the detected pressure value becomes equal to the fixing pressure, the pressure control means outputs a command to the pressure regulator 32 to stop the driver 31. Consequently, the pinion 55 is stopped, the lack 53 is stopped, and the movable base 52 is stopped. As a result, the coil spring 26 is stopped to keep constant the pressure with which the pressure roller 25 is pressed against the heat roller 24.

When the detected pressure value becomes higher than the fixing pressure, the pressure control means outputs a command to the pressure regulator 32 to drive the driver 31 in the direction of arrow G. Consequently, the pinion 55 is rotated in the same direction, the lack 53 is moved backward in the direction of arrow C, and the movable base 52 is rotated in the direction of arrow E and moved downward. As a result, the coil spring 26 is moved downward, reducing the pressure with which the pressure roller 25 is pressed against the heat roller 24. Thus, the pressure of the pressure roller 25 is controlled such that the detected pressure value becomes substantially equal to the fixing pressure, keeping substantially constant the pressure with which the pressure roller 25 is pressed against the heat roller 24.

The operation of the printer 20 will be described when the print data is sent to the printer 20 directly from the computer 11 or indirectly from a computer CP1, CP2, . . . via the network NW. When a print data and a print start command are sent from the application 13 of the computer 11 or an application (not shown) within a computer CP1, CP2, . . . , the main control section 39 receives the print data and the print start command via the data transmission unit 41, the heat control means makes the detected temperature value substantially equal to the fixing temperature, and the pressure control means makes the detected pressure substantially equal to the fixing pressure.

Then, the transfer means (not shown) of the main control section 39 performs a transfer process to output a command to the driver control 38 to drive the driver 37. The rotation produced by the driver 37 is transmitted to the heat roller 24 via the driver gear for rotation in the direction of arrow H, which rotates the pressure roller 25 in the direction of arrow I. The recording medium 22 is transferred in the direction of arrow A and receives the toner image. When it reaches the pressure area between the heat roller 24 and the pressure roller 25, the recording medium 22 is heated by the heat roller 24 and pressed by the pressure roller 25, and the toner image is fixed to the recording medium 22.

Where the fixation of the toner image to the recording medium 22 discharged from the printer 20 is so weak that the toner falls from the recording medium 22, the figure of the fixing temperature or pressure within the spin box f1 or f2 is increased to increase the fixation of the toner image. Where the fixation of a toner image is good but the recording medium 22 discharged from the printer 20 is curled, the figure of the fixing temperature or pressure within the spin box f1 or f2 is decreased to control the curl. For the recording medium 22 susceptible to wrinkling under large pressures, such as an envelope with two sheets of paper superimposed, the figure of fixing temperature within the spin box f1 is increased while the figure of the fixing pressure within the spin box f2 is decreased to control the wrinkling while keeping the fixation of a toner image at good conditions.

According to the embodiment, when printing is desired on a given recording medium 22, the fixing temperature and pressure are entered as direct fixing conditions instead of the indirect fixing conditions such as the environmental temperature and humidity, and the thickness and type of the recording medium 22 so that the optimal image quality can be obtained for the given recording medium 22.

Based on the conditions of the recording medium 22 discharged from the printer 20, the fixing conditions can be changed to regulate the heat roller 24 or the pressure roller 25 so that the image quality is further improved for the given recording medium 22. Since the fixing conditions and the transfer voltage are set independently, when the "thick" is selected for the recording medium 22 to provide the good fixation of a toner image, the influence upon the transfer is so small that the image does not become blur.

When the fixing conditions are inputted into the computer 11, the identification information of the computer 11 is sent to the printer 20 so that printing is made under the fixing conditions corresponding to the identification information. For other computers CP1, CP2, . . . connected to the network NW, the setting tables recorded in the recording unit 40 are looked up, and printing is made with the standard fixing conditions so that it is possible to use different types of the recording mediums 22 between the computer 11 and the other computers CP1, CP2, . . . . Where the recording medium 22 for use in the computer 11 is used for printing by the other computer CP1, CP2, . . . , it is possible to manipulate the operation unit 42 of the printer 20 to enter and set the optimal fixing conditions. In this case, printing can be made without using applications for entering the fixing conditions in the computers CP1, CP2, . . . .

Figure 6:
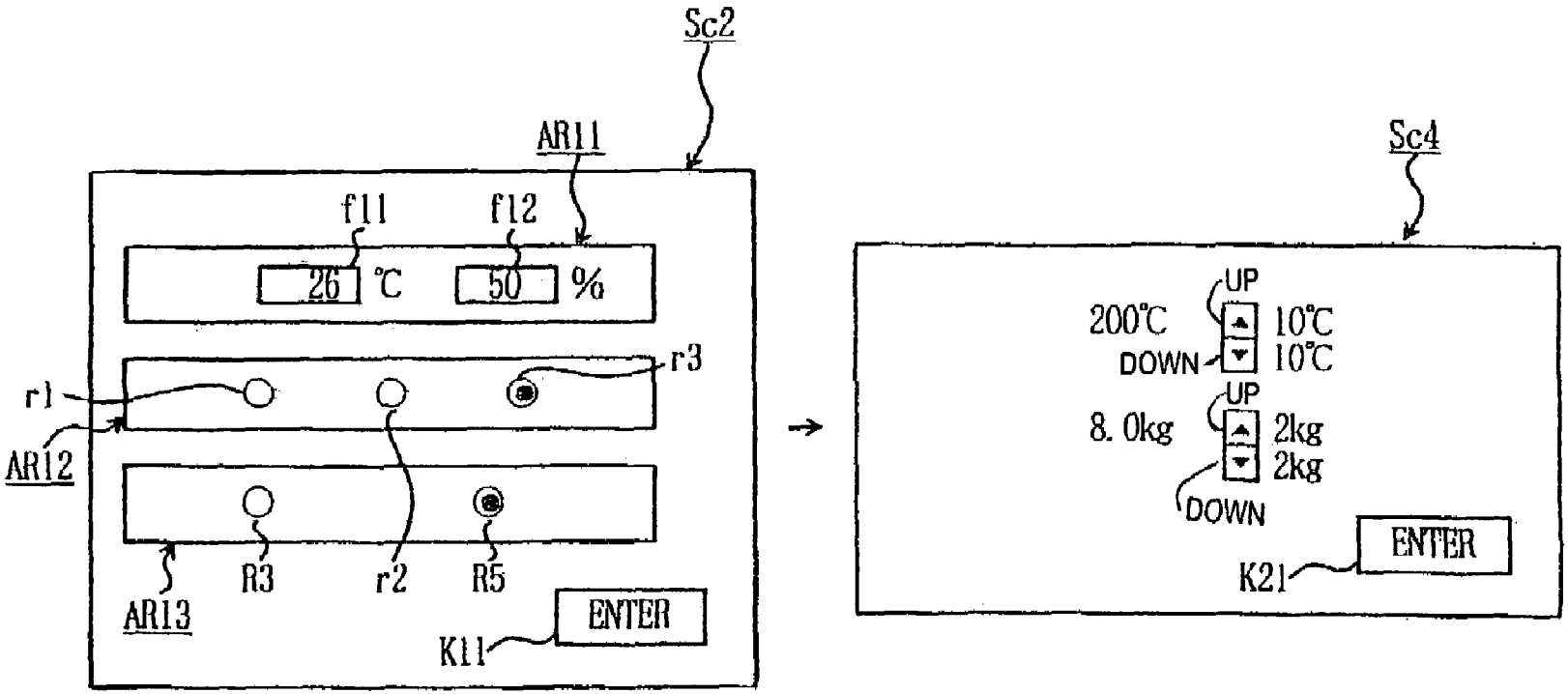
FIG. 6 is a diagram showing an application environment input screen and the fixing condition set screen according to the third embodiment.

Alternatively, the fixing temperature and pressure may be changed by manipulating the operation unit 42 of the printer 20. The printer 20 has a manipulation input section 43 which corresponds to the button "UP" and "DOWN" and "ENTER" key k1 as shown in FIGS. 4 and 6. Similarly to the display section 11C of the upper unit or computer 11, the selected fixing conditions such as the input range and selected values of fixing conditions in the screens Sc11, Sc12, Sc13, and Sc14 are displayed on the display section 44 of the printer 20.

The second embodiment wherein an unskilled operator can set the fixing conditions with the application 13 without difficulty will be described with reference to FIG. 5.

Figure 5:
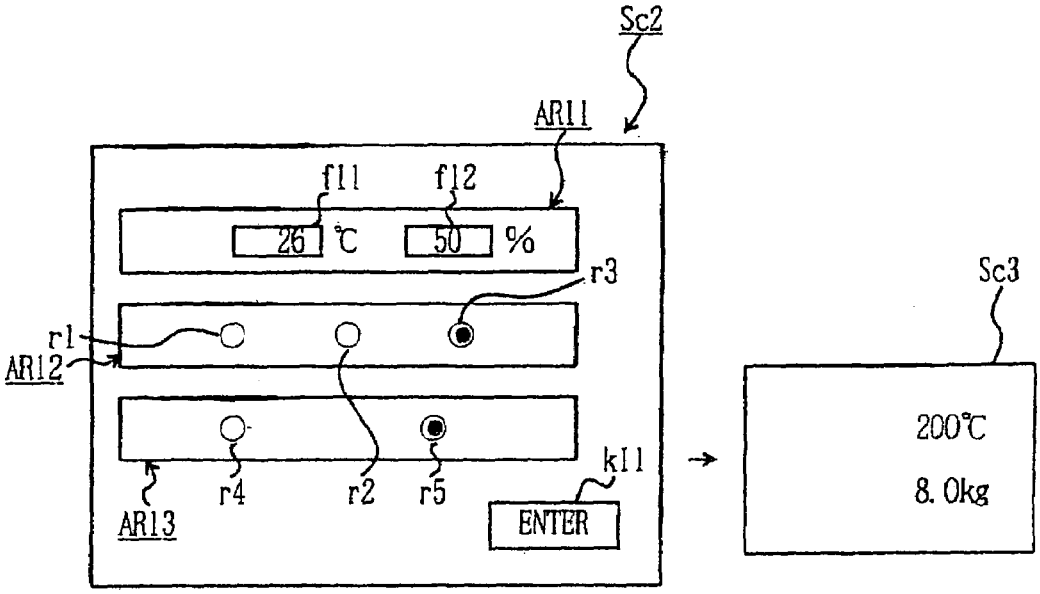
FIG. 5 is a diagram showing an application environment input screen and a standard set value display screen according to the second embodiment.

When the operator manipulates the operation section 11*b* of the computer 11 (FIG. 1) to select the fixing condition menu, the display process means in the control section of the computer 11 performs a display process to form on the display section 11*c* such an application environment input screen (Sc2) as shown in FIG. 5. The application environment input screen (Sc2) includes an area AR11 for entering the environment, an area AR12 for entering the thickness of recording medium 22, and an area AR13 for entering the type of recording medium 22 for entering the environment in which the printer 20 is used. The area AR11 has an edit box f11 for entering the temperature and an edit box f12 for entering the humidity. The area AR12 has three radio buttons r1–r3 to select "thin", "ordinary", or "thick" for the thickness of recording medium 22. The area AR13 has two radio buttons r4 and r5 to select "ordinary" or "rough" for the type of recording medium 22.

Then, the operator manipulates the operation section 11*b* to enter figures of the temperature and pressure in the edit boxes f11 and f12 for the environmental conditions. Then, he clicks the radio button r1, r2, or r3 to select the thickness of recording medium 22 and the radio button r4 or r5 to select the type of recording medium 22. When the operator depresses the ENTER key k11, the figures entered in the edit boxes f11 and f12 and the selected thickness and type of recording medium 22 are confirmed as the application environment and sent to the printer 20 by the driver software 14 together with a predetermined command set.

When the computer 11 sends the application environment to the printer 20, the standard value computing means (not shown) of the main control section 39 performs a standard value computing process to temporarily record the application environment in the recording unit 40, look up the setting tables to read the standard fixing conditions suitable for the application environment, and send the computed standard values to the computer 11. The display means of the computer 11 forms a standard value display screen Sc3 and display on the standard value display screen Sc3 the standard fixing conditions sent from the printer 20. Alternatively, the temperature, humidity, and the type and thickness of recording medium 22 to be entered may be detected by a variety of sensors of the printer 20 such as a temperature sensor, a humidity sensor, a paper thickness sensor, and a medium sensor.

There are not only the upper limit of the fixing temperature above which the resinous parts of the printing mechanism are deformed or the load of the spring exceeds the breaking point but also the lower limit of the fixing temperature below which the fixing becomes impossible. Thus, when the application 13 of the computer 11 connected to the printer 20 is started, it sends to the printer 20 a requirement command of the setting limits via the driver software 14. When the printer 20 receives the requirement command, the main control section 39 reads the fixing conditions from the recording unit 40 and sends to the computer 11 the requirement conditions to which the upper and lower limits of the fixing temperature and the upper and lower limits of the fixing pressure are added.

When the display process means receives the fixing conditions and the upper and lower limits, it forms a fixing condition setting screen Sc1 (FIG. 1). The fixing condition setting screen Sc1 has the spin box f1 for entering the fixing temperature and the spin box f2 for entering the fixing pressure. The standard fixing temperature and pressure are displayed in the spin boxes f1 and f2, respectively, and the respective upper and lower limits are displayed in the area AR1. Thus, the operator can change the figures in the spin boxes f1 and f2 and the fixing conditions according to the conditions of the recording medium 22 discharged from the printer 20 and the input range display in the area AR1.

When the figures of the spin boxes f1 and f2 on the fixing condition setting screen Sc1 are changed without displaying the input range in the area AR1, it is possible to determine the fixing conditions. The fixing condition determination means in the control section of the computer 11 performs a fixing condition determination process to determine whether the changed fixing temperature or pressure exceeds the input range and, if the fixing temperature or pressure exceeds the input range, the warning means in the control section of the computer 11 performs a warning process to issue a warning and notify the operator that the fixing temperature or pressure exceeds the input range. Alternatively, the fixing conditions may be set by manipulating the operation unit 42 of the printer 20. Since the fixing conditions are set in the printer 20, printing may be made according to data from the computer CP1, CP2, . . . other than the computer 11.

According to the second embodiment, the temperature and humidity are inputted directly into the edit boxes f11 and f12 and the radio button r1, r2, or r3 is clicked to select the thickness of recording medium 22, and the radio button r4 or r5 is clicked to select the type of recording medium 22 to set and display the standard fixing conditions so that the unskillful operator can set the optimal fixing conditions without difficulty. Also, it is prevented that the fixing conditions are inputted by error so that damage to the printer 20 can be avoided.

When the standard fixing conditions are set, the fixing condition setting screen Sc1 is formed, and the standard fixing temperature and pressure are displayed in the spin boxes f1 and f2, respectively, on the fixing condition setting screen Sc1. The fixing conditions can be changed by changing the figures of the spin boxes f1 and f2 according to the conditions of the recording medium 22 discharged from the printer 20 and the input range displayed in the area AR1. The figures of spin boxes f1 and f2 must be input in absolute values and it is difficult to estimate the optimal fixing conditions.

Alternatively, the fixing temperature and pressure may be changed by manipulating the operation unit 42 of the printer 20. The printer 20 has a manipulation input section 43 which corresponds to the button "UP" and "DOWN" and "ENTER" key k1 as shown in FIGS. 4 and 6. Similarly to the display section 11C of the upper unit or computer 11, the selected fixing conditions such as the input range and selected values of fixing conditions in the screens Sc11, Sc12, Sc13, and Sc14 are displayed on the display section 44 of the printer 20.

The third embodiment wherein the standard fixing conditions can be changed by inputting relative values will be described with reference to FIG. 6.

In FIG. 6, when the operator manipulates the operation section 11*b* of the computer 11 (FIG. 1) to select the fixing condition setting menu, the display process means in the control section of the computer 11 performs a display process to form on the display section 11*c* such an application environment input screen Sc2 as shown in FIG. 6. The application environment input screen Sc2 includes an area AR11 for inputting the peripheral environment, an area AR12 for inputting the thickness of recording medium 22, and an area AR13 for inputting the type of recording medium 22. The area AR11 has edit boxes f11 and f12 for inputting the temperature and humidity, respectively, the area AR12 has three radio buttons r1–r3 to select "thin", "ordinary", or "thick" for the thickness of recording medium 22, and the area AR13 has two radio buttons r4 and r5 to select "ordinary paper" or "rough paper", respectively.

Then, the operator manipulates the operation section 11*b* to input figures of the temperature and humidity in the edit boxes f11 and f12. Then, he clicks the radio button r1, r2, or r3 to select the thickness of recording medium 22 and radio button r4 or r5 to select the type of the recording medium 22. When the operator depressed the ENTER key k11, the figures of the edit boxes f11 and f12, and the thickness and type of the recording medium 22 are confirmed as the application environment, which is sent by the driver software 14 to the printer 20 together with a predetermined command set.

When the printer 20 receives the application environment from the computer 11, the fixing condition setting means of the main control section 39 performs a fixing condition setting process to temporarily record the application environment in the recording unit 40, read, in view of the setting tables, the standard fixing conditions suitable for the application environment, and send them to the computer 11. The display process means of the computer 11 forms a fixing condition setting screen Sc4 and displays the standard fixing conditions sent from the printer as standard setting values and figure changing buttons "UP" and "DOWN" for changing the standard setting values.

In this embodiment, the fixing temperature is increased by 10 degrees cent. every time the "UP" button is depressed and decreased by 10 degrees cent. every time the "DOWN" button is depressed. The fixing pressure is increased by 2 kg every time the "UP" button is depressed and decreased by 2 kg every time the "DOWN" is depressed. The changed values are set so as to change the image quality sensitively or quantitatively.

For example, when the operator inputs a certain application environment on the application environment input screen Sc2 and depresses the ENTER key k11, 200 degrees cent. and 8.0 kg are displayed on the fixing condition setting screen Sc4 for the standard fixing temperature and pressure, respectively. When, in view of the actual recording medium 22, the operator depresses the button "UP" or "DOWN" to change the fixing temperature or pressure and depresses the ENTER key k21, the fixing conditions are inputted and confirmed as relative values to the standard fixing conditions.

When the fixing conditions are set, the driver software 14 sends a predetermined command set to the printer 20, and the printing means (not shown) of the main control section 39 performs a printing process to read the fixing conditions from the recording unit 40 and control the fixing unit 21 with the fixing conditions for printing on the recording medium 22 prepared by the operator.

Alternatively, the fixing temperature and pressure may be changed by manipulating the operation unit 42 of the printer 20. The printer 20 has a manipulation input section 43 which corresponds to the button "UP" and "DOWN" and "ENTER" key k1 as shown in FIGS. 4 and 6. Similarly to the display section 11C of the upper unit or computer 11, the selected fixing conditions such as the input range and selected values of fixing conditions in the screens Sc11, Sc12, Sc13, and Sc14 are displayed on the display section 44 of the printer 20.

When the fixing conditions are set, the transfer voltage applied to the transfer roller may be set. Thus, according to the third embodiment, it is unnecessary to input the absolute values for the fixing temperature and pressure, and the relative values of the fixing temperature and pressure are inputted based on the preset changed values so that it is unnecessary to estimate the optical fixing conditions.

It is noted that the invention is not limited to the above illustrated embodiments and various modifications may be made according to the sprit of the invention but they would fall within the scope of the invention.

The invention claimed is:

1. An image forming apparatus comprising:

an image forming unit for forming a developer image on a recording medium;

a fixing unit for fixing said developer image on said recording medium;

an operation unit;

a selection unit provided in the operation unit for selecting increase or decrease of at least one of fixing conditions by a specific value;

a display unit for displaying the specific value; and a fixing unit regulation unit for regulating said fixing unit based on the fixing conditions set by manipulating said operation unit.

2. The image forming apparatus according to claim 1, which further comprises:

a display process unit for forming a fixing condition setting screen on said display unit and displaying said fixing conditions on said fixing condition setting screen.

3. The image forming apparatus according to claim 2, wherein said display process unit displays an input range of said fixing conditions on said fixing condition setting screen.

4. The image forming apparatus according to claim 3, which further comprises a fixing condition determination unit for determining whether said fixing conditions exceed said input range.

5. The image forming apparatus according to claim 4, which further comprises a warning unit for issuing a warning when said fixing condition determination unit determines that said fixing conditions exceed said input range.

6. The image forming apparatus according to claim 2, which further comprises a standard set value computing unit for computing, when an application environment of said image forming apparatus is inputted, standard set values of said fixing conditions so that said display process unit displays said standard set values on a standard set value display screen formed on said display unit.

7. The image forming apparatus according to claim 2, which further comprises a recording section for recording said fixing conditions corresponding to an environment and said recording medium.

8. The image forming apparatus according to claim 1, wherein said fixing unit regulation unit regulates, based on said fixing conditions, a pressure applied to said recording medium by said fixing unit.

9. The image forming apparatus according to claim 1, wherein said operation unit sets the fixing conditions according to a number of operations of the selection unit after the display unit displays a standard set value stored in advance as the specific value.

10. The image forming apparatus according to claim 1, further comprising a pressure roller and a pressure regulation mechanism for pressing the pressure roller, said pressure regulation mechanism including a spring for pressing the pressure roller and a movable support for supporting the spring at a variable position according to a pressure condition set by the fixing conditions.

11. The image forming apparatus according to claim 10, wherein said pressure regulation mechanism further includes a pressure sensor for detecting pressure applied to the spring, said pressure regulation mechanism moving the movable support according to a detection result of the pressure sensor.

12. An image forming system including a printer and a computer, said printer comprising:

an image forming unit for forming a developer image on a recording medium; and a fixing unit for fixing said developer image on said recording medium; said computer comprising:

an operation unit;

a selection unit provided in the operation unit for selecting increase or decrease of at least one of fixing conditions by a specific value;

a display unit for displaying the specific value; and a fixing unit regulation unit for regulating said fixing unit based on the fixing conditions set by manipulating said operation unit.

13. The image forming system according to claim 12, wherein said computer further comprises:

a display process unit for forming a fixing condition setting screen on said display unit and displaying said fixing conditions on said fixing condition setting screen.

14. The image forming system according to claim 13, wherein said display process unit displays an input range of said fixing conditions on said fixing condition setting screen.

15. The image forming system according to claim 14, wherein said computer further comprises a fixing condition determination unit for determining whether said fixing conditions exceed said input range.

16. The image forming system according to claim 15, wherein said computer further comprises a warning unit for issuing a warning when said fixing condition determination unit determines that said fixing conditions exceed said input range.

17. The image forming system according to claim 13, wherein said computer further comprises a standard set value computing unit for computing, when an application environment of said image forming apparatus is inputted, standard set values of said fixing conditions so that said display process unit displays said standard set values on a standard set value display screen formed on said display unit.

18. The image forming system according to claim 13, wherein said computer further comprises a recording section for recording said fixing conditions corresponding to an environment and said recording medium.

19. The image forming system according to claim 12, wherein said fixing unit regulation unit regulates, based on said fixing conditions, a pressure applied to said recording medium by said fixing unit.

* * * * *